US005206960A

United States Patent [19]

Hooshley et al.

[11] Patent Number: 5,206,960

[45] Date of Patent: May 4, 1993

[54] DUAL FLUSH TOILET CONTROL MECHANISM

[75] Inventors: Robert L. Hooshley, 59 Lockton, Brampton, Ontario, Canada, L6W 1C2; Paul T. Arato, Willowdale, Canada; F. William Coffman, Toronto, Canada

[73] Assignee: Robert L. Hooshley, Brampton, Canada

[21] Appl. No.: 774,873

[22] Filed: Oct. 11, 1991

[51] Int. Cl.[5] ..... E03D 1/14

[52] U.S. Cl. ..... 4/325; 4/384

[58] Field of Search ..... 4/324, 325, 379, 381, 4/384, 405, 413, 414, 415, 249

[56] References Cited

U.S. PATENT DOCUMENTS

| | | | |
|---|---|---|---|
| 1,290,905 | 1/1919 | Callow | 4/324 X |
| 1,638,161 | 8/1927 | Kirk | 4/414 |
| 2,001,390 | 5/1935 | Lester | 4/325 |
| 2,526,294 | 10/1950 | Stegeman | 4/325 |
| 2,548,658 | 4/1951 | Duncan | 4/414 |
| 2,744,261 | 5/1956 | Gram | 4/325 |
| 3,093,833 | 6/1963 | Nardone | 4/325 |
| 3,421,161 | 1/1969 | Stafford et al. | 4/325 |
| 3,777,316 | 12/1973 | Coetzee | 4/34 |
| 3,823,425 | 7/1974 | Coffman | 4/325 X |
| 4,080,668 | 3/1978 | Banes | 4/325 |
| 4,145,774 | 3/1979 | Sullivan | 4/325 |
| 4,173,044 | 11/1979 | Ota | 4/325 |
| 4,225,987 | 10/1980 | Goldman et al. | 4/325 |
| 4,620,331 | 11/1986 | Sagucio | 4/324 X |
| 4,764,995 | 8/1988 | Harney | 4/325 |
| 4,864,665 | 9/1989 | Toltzman | 4/325 |
| 4,881,279 | 11/1989 | Harney | 4/324 |
| 4,945,580 | 8/1990 | Schmitt et al. | 4/405 X |

*Primary Examiner*—William A. Cuchlinski, Jr.
*Assistant Examiner*—John L. Beres
*Attorney, Agent, or Firm*—Richard C. Litman

[57] ABSTRACT

A dual flush toilet control mechanism includes an operating handle and attached actuating cam, a control arm and a control float arm. When the handle is turned in a first direction, the actuating cam moves the control arm to open fully a conventional toilet tank main valve to its buoyant position. When turned the handle is turned in a second direction, the actuating cam moves the control arm to open partially the main valve to a position wherein it is subject to the suction developed by the water exiting the toilet tank. A control cam on the control float arm maintains the control arm in position to maintain the main valve open against the suction until the water level in the tank drops below a predetermined level. When the float on the control float arm reaches the predetermined water level, the attached control cam allows the control arm to drop and the main valve to close.

7 Claims, 7 Drawing Sheets

DUAL FLUSH TOILET CONTROL MECHANISM

FIELD OF THE INVENTION

The present invention relates to dual flush toilets and specifically to a novel control mechanism for providing dual flush capabilities in new toilets or for retrofitting in existing toilets.

BACKGROUND OF THE INVENTION

Dual flush toilets are well known and allow the user the choice of effecting a large volume, "long" flush to dispose of solid waste or a smaller volume, "short" flush to dispose of liquid waste. It has previously been determined that typically the majority of flushes could be short flushes and thus a significant reduction can be obtained in the requirements for fresh water by the use of dual flush toilets. Furthermore, a corresponding reduction in the volume of sewage produced can also be obtained. These reductions offer economic benefits to those households with metered water usage, and environmental benefits by reducing fresh water usage by a toilet and the volume of sewage produced by the toilet which must be treated.

An example of a prior art dual flush toilet is shown in U.S. Pat. No. 4,225,987 to Goldman et al. This reference shows a dual flush mechanism which requires a modified ball valve and a complex vent control means to be installed in the toilet tank. The ball valve in this reference includes a vented outlet to release the air from the ball to eliminate the valve's buoyancy. The vent control means is attached to two flush handles each of which corresponds to a particular length flush and has an associated float control arm. When either handle is depressed, the valve is opened and water leaves the tank until the float control arm corresponding to the pressed handle drops as the water exiting the toilet tank drops below its float. When the float control arm drops, the air is vented from the ball and the valve closes. The handle which provides a long flush accordingly has a long float control arm and the handle which provides a short flush has a shorter float control arm.

Another example of a prior art dual flush toilet is shown in U.S. Pat. No. 4,864,665 to Toltzman. This reference teaches a dual flush mechanism with two flush handles. Operation of one of the flush handles, corresponding to a long flush, results in the ball valve being lifted to its buoyant position and the toilet flushes in the normal manner. Operation of the flush handle corresponding to a short flush, results in the ball valve being lifted just off of its seat so that the ball valve is subject to the venturi effect, or suction, generated by the water flowing out of the tank through the valve seat. The ball valve remains open only so long as the user maintains the short flush handle in its depressed position which keeps the ball valve in its open position. Thus, the user of the toilet is required to maintain the short flush handle in the depressed position just long enough to ensure disposal of the liquid waste in the toilet bowl and then to release the handle to allow the ball valve to close, terminating the flush.

Another prior art example of a dual flush toilet is shown in U.S. Pat. No. 4,764,995 to Harney. This reference shows a mechanism similar in concept to that shown in the above-mentioned Toltzman reference except the duration of the short flush is controlled by a control float which actuates a rack and pinion arrangement. When a short flush is selected, the rack operates to maintain the ball valve in a slightly opened position until the control float drops to a predefined level. Thus, there is no need for the user to maintain the handle in the depressed position as the flush will terminate automatically.

While many different prior art dual flush systems exist, they each have problems and disadvantages associated with them. Some prior art systems, like the Toltzman system, require the operator to control manually the duration of the short flush. Other prior art systems, like the Goldman et al. reference, require a substantial modification of the toilet tank hardware, such as a replacement of the main valve and seat. Still other prior art systems, like the Harney reference, require a control mechanism which is complex, and therefore expensive to manufacture, and which may be difficult to install and adjust in existing toilet systems.

SUMMARY OF THE INVENTION

It is therefore an object of the present invention to provide a novel dual flush control mechanism which obviates or mitigates at least some of the problems and disadvantages associated with the prior art systems.

According to one aspect of the present invention, there is provided a dual flush control mechanism for a toilet having a main valve between the bowl and tank of the toilet, said valve being operable between a closed position, an intermediate position and an open position wherein said valve remains open until said tank is substantially emptied, comprising: an operating handle movable to first and second extents; a valve control arm operably connected to said valve; and a control float arm movable with changes in the water level in said tank, wherein movement of said handle to said first extent causes said valve control arm to move said valve to said open position and movement of said handle to said second extent causes said valve control arm to move said valve into said intermediate position, said control float arm conditioning said valve control arm to release said valve when the water level in said tank drops below a predetermined level.

Preferably, the valve control arm includes a first cam follower which abuts an actuating cam connected to the handle and which operates the valve control arm to move the valve between the open and intermediate positions. Also preferably, the valve control arm includes a second cam follower which abuts a control cam connected to the float control arm, the second cam follower and the control cam operating to inhibit closure of the valve during a short flush until the water level has dropped below the predetermined level.

It is also preferred that the position of the control cam with respect to the float control arm be variable to allow the predetermined level to be altered.

According to another aspect of the present invention, there is provided a toilet comprising: a water tank; a bowl connected to said water tank to allow water to drain from said tank into said bowl; a water entry control mechanism to control the filling of the tank; a main valve to inhibit water flow from said tank to said bowl, said valve operable between a closed position, an intermediate position and an open position wherein said valve remains open until said tank is substantially emptied; and a dual flush control mechanism to control said main valve including an operating handle movable between first and second extents, a valve control arm operably connected to said valve, and a control float arm movable with changes in the water level in said tank, wherein movement of said handle to said first extent causes said valve control arm to move said valve to said open position and movement of said handle to said second extent causes said valve control arm to move said valve into said intermediate position, said control float arm conditioning said valve control arm to release said valve when the water level in said tank drops below a predetermined level.

The present invention provides major advantages over prior art mechanisms including the simplicity of single handle operation and the reliability afforded by the cambased control system.

BRIEF DESCRIPTION OF THE DRAWINGS

A preferred embodiment of the present invention will now be described, by way of example only, with reference to the attached figures wherein.

DESCRIPTION OF THE PREFERRED EMBODIMENTS

Figure 1:
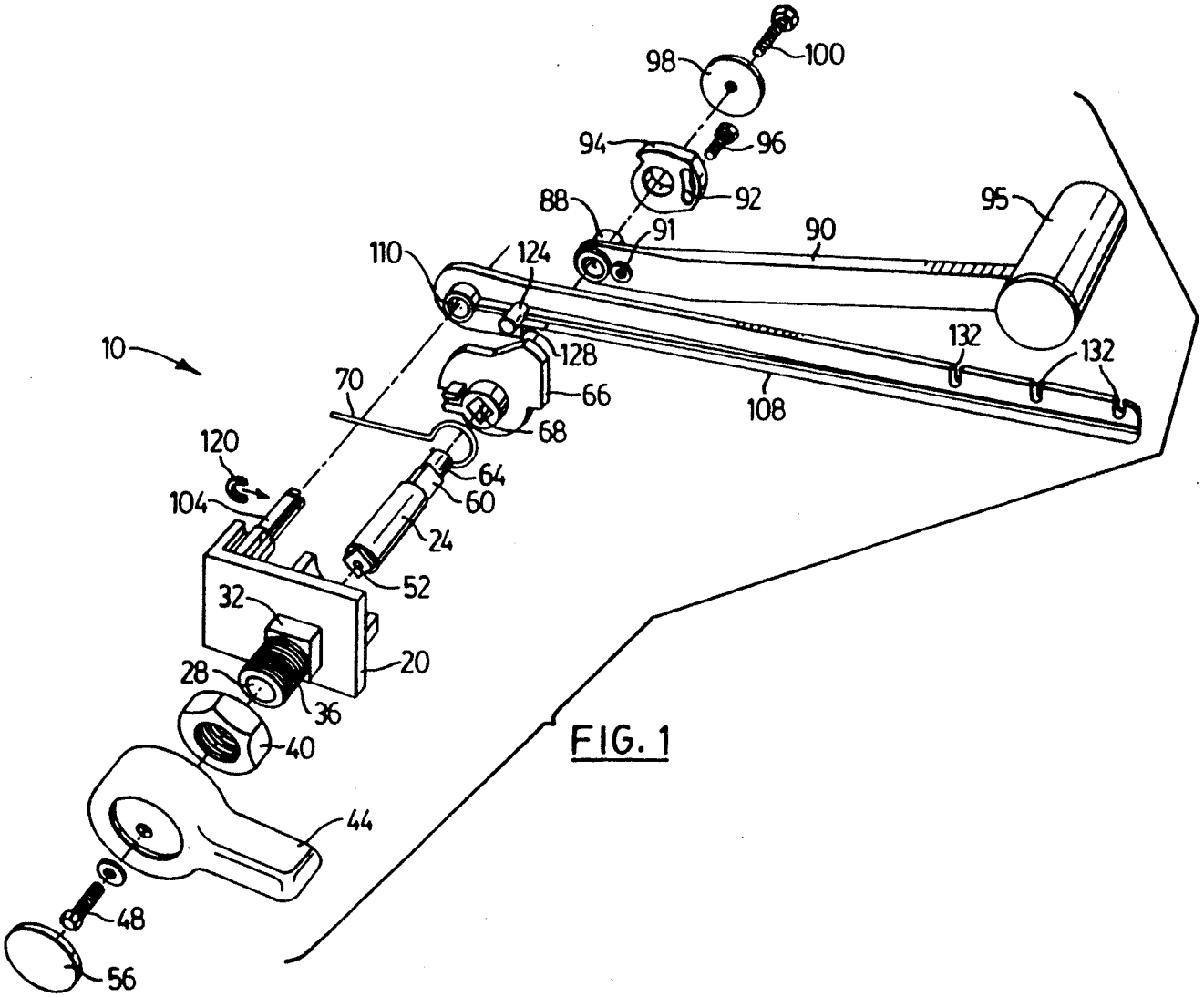
FIG. 1 shows an exploded perspective view of a dual flush control mechanism.
Figure 2:
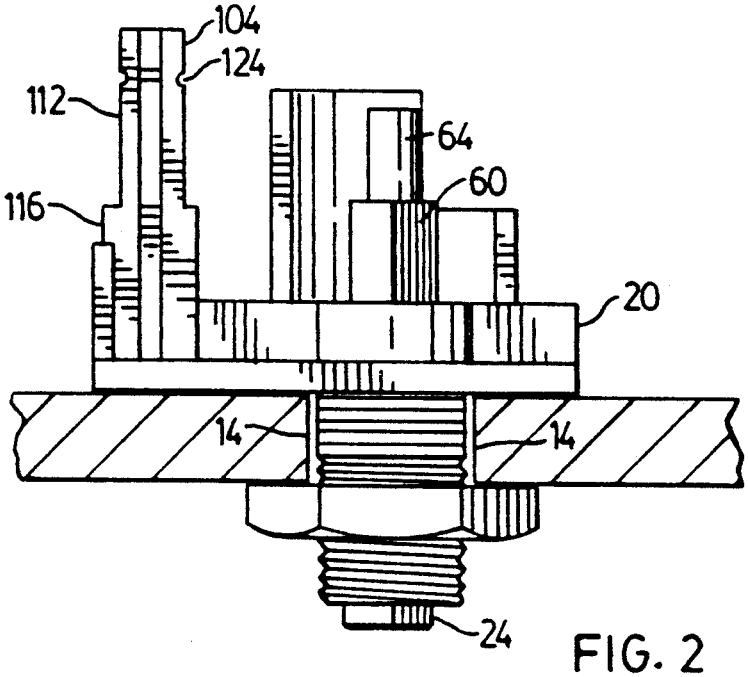
FIG. 2 shows a section of a mounting plate for the control mechanism of FIG. 1 attached to a toilet tank.
Figure 3:
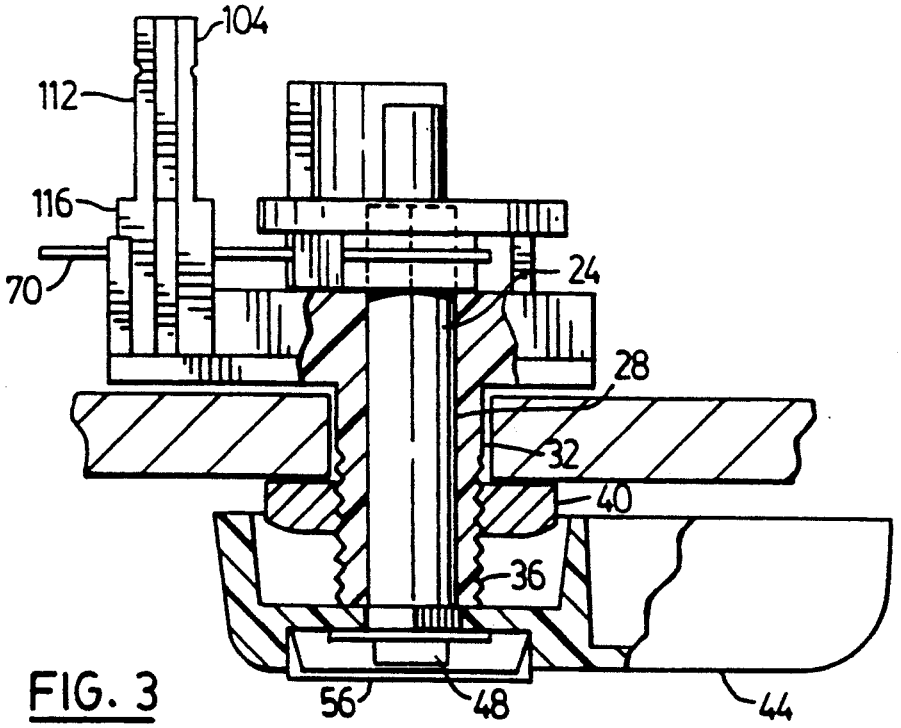
FIG. 3 shows the section of FIG. 2 with a handle, spring and an actuating cam attached.
Figure 4:
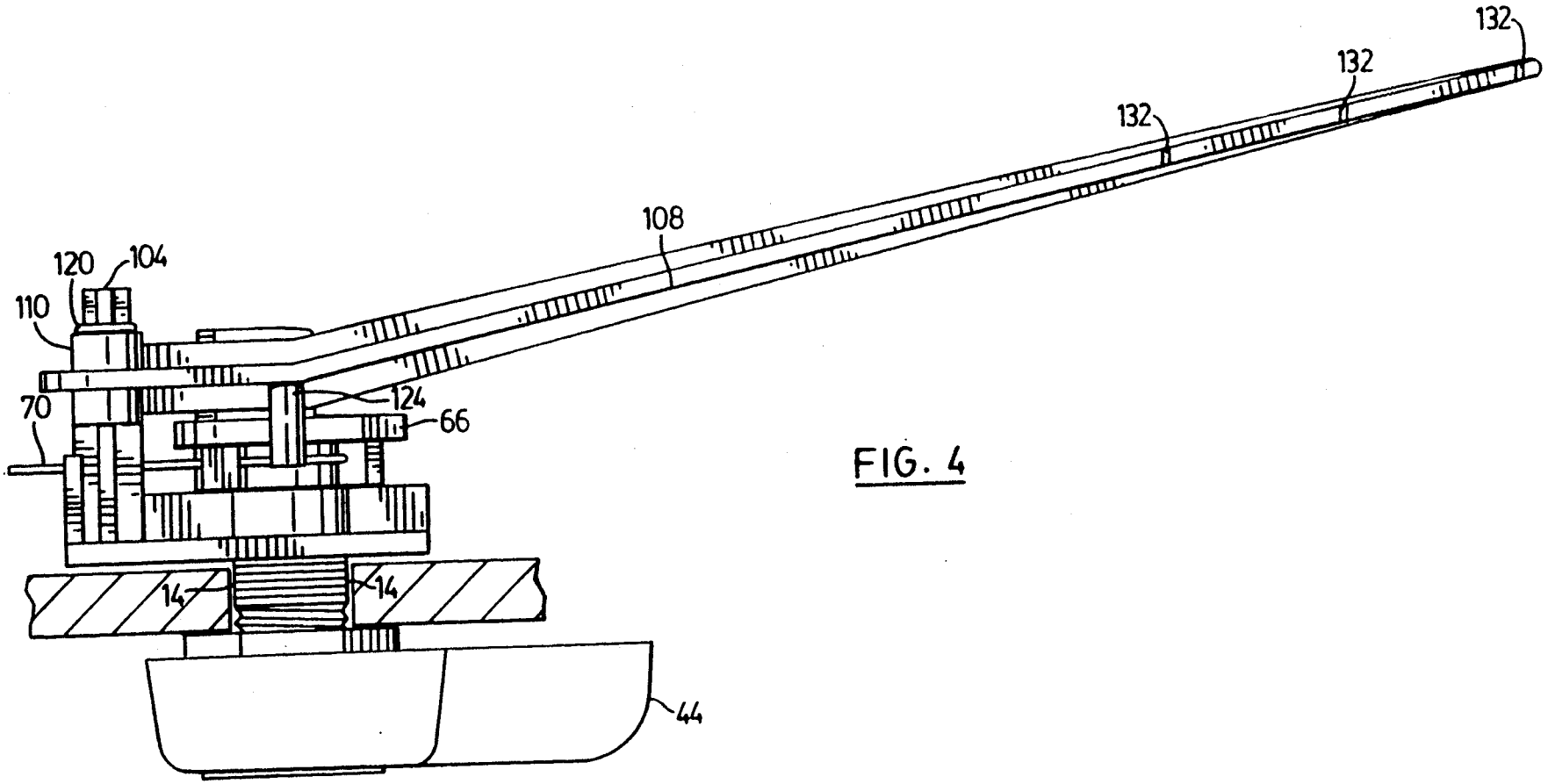
FIG. 4 shows the section of FIG. 3 with a valve control arm attached.
Figure 5:
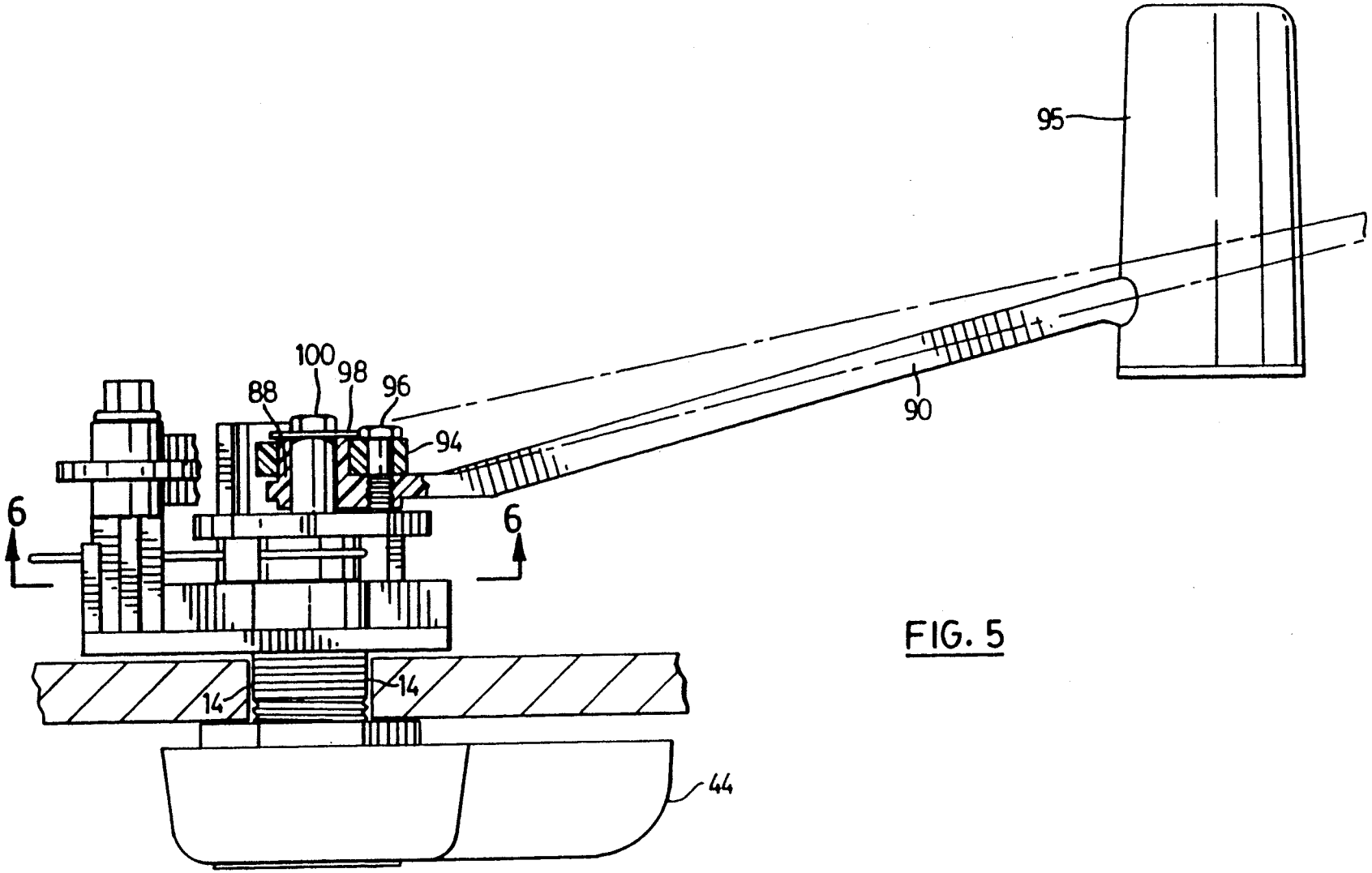
FIG. 5 shows the section of FIG. 4 with a control float arm attached and with the valve control arm shown in ghosted lines.

Conventional toilets include a bowl for receiving waste, a tank for storing water to flush the waste from the bowl and a conduit between the tank and the bowl to allow the water to empty from the tank to the bowl. The tank typically includes a mechanism to control the refilling of the tank after a flush and these mechanisms are well known to those of skill in the art and will not be further discussed herein.

A main valve is employed in the tank to control the emptying of water from the tank into the conduit and bowl. These valves are also well known to those of skill in the art and will not be described in further detail herein.

Referring now to the attached figures, a dual flush control mechanism is indicated generally at 10. The mechanism includes a mounting plate 20 and an actuating shaft 24 which passes through a bore 28 in plate 20. Shaft 24 and bore 28 are sized to facilitate easy rotation of shaft 24 within bore 28.

The front of plate 20 includes a boss with a square keyed portion 32 and a threaded portion 36. In use, the plate 20 is installed in a toilet tank 12 with the keyed portion 32 engaging the walls 14 of the existing aperture for a flush operating handle and a nut 40 engaging the threaded portion 36 to maintain the plate 20 in place. As will be understood by those of skill in the art, it is contemplated that an adapter may also be inserted between the keyed portion 32 and the walls of the operating handle aperture if the shape of the aperture does not correspond to the shape of the keyed portion 32.

An operating handle 44 is attached to the front end of shaft 24 by a screw 48 which is received in a bore in the shaft 24 and rotation of the handle 44 thus results in corresponding rotation of the shaft 24. A decorative cover 56 may be applied to handle 44 to hide the head of screw 48.

The other end of shaft 24 terminates in a square keyed portion 60 and a round portion 64. The keyed portion 60 receives an actuator cam 66 which includes a keyed bushing 68 complementary to portion 60 so that the actuator cam 66 rotates with shaft 24. A hook-shaped spring 70, as best seen in FIG. 1, encircles bushing 68 and its arm is received between a pair of bosses 82 on actuator cam 66 and between a pair of bosses 86 on plate 20. Spring 70 thus operates to urge handle 44 and shaft 24 to the centered, or datum, position shown in FIG. 7 when it is rotated in either a clockwise or counterclockwise direction.

The round portion 64 of shaft 24 extends beyond actuator cam 66 and is received in a bushing 88 which is at one end of control float arm 90 and which allows arm 90 to pivot about shaft 24. A control cam 94 is received on bushing 88. As shown in FIG. 1, control cam 94 includes a keyway 92 through which a screw 96 passes to engage a bore 91. Movement of the keyway 92 about screw 96 allows the position of cam 94 to be altered with respect to arm 90.

The end of arm 90 opposite bushing 88 includes a float 95 which can be constructed of a buoyant material, such as styrofoam, or may be a hollow air-filled chamber, or may be any other suitably buoyant construction as would be apparent to those of skill in the art. Both control float arm 90 and control cam 94 are maintained in place by washer 98 and screw 100 which is received in a bore at the end of shaft 24.

Mounting plate 20 also includes pivot rod 104 which receives control arm 108. Control arm 108 includes a bushing 110 which fits over a reduced diameter portion 112 of rod 104 and which allows arm 108 to pivot about rod 104. Arm 108 is maintained in abutment against a large diameter portion 116 by a C clip 120 which is received in notch 124 formed in rod 104.

Figure 6:
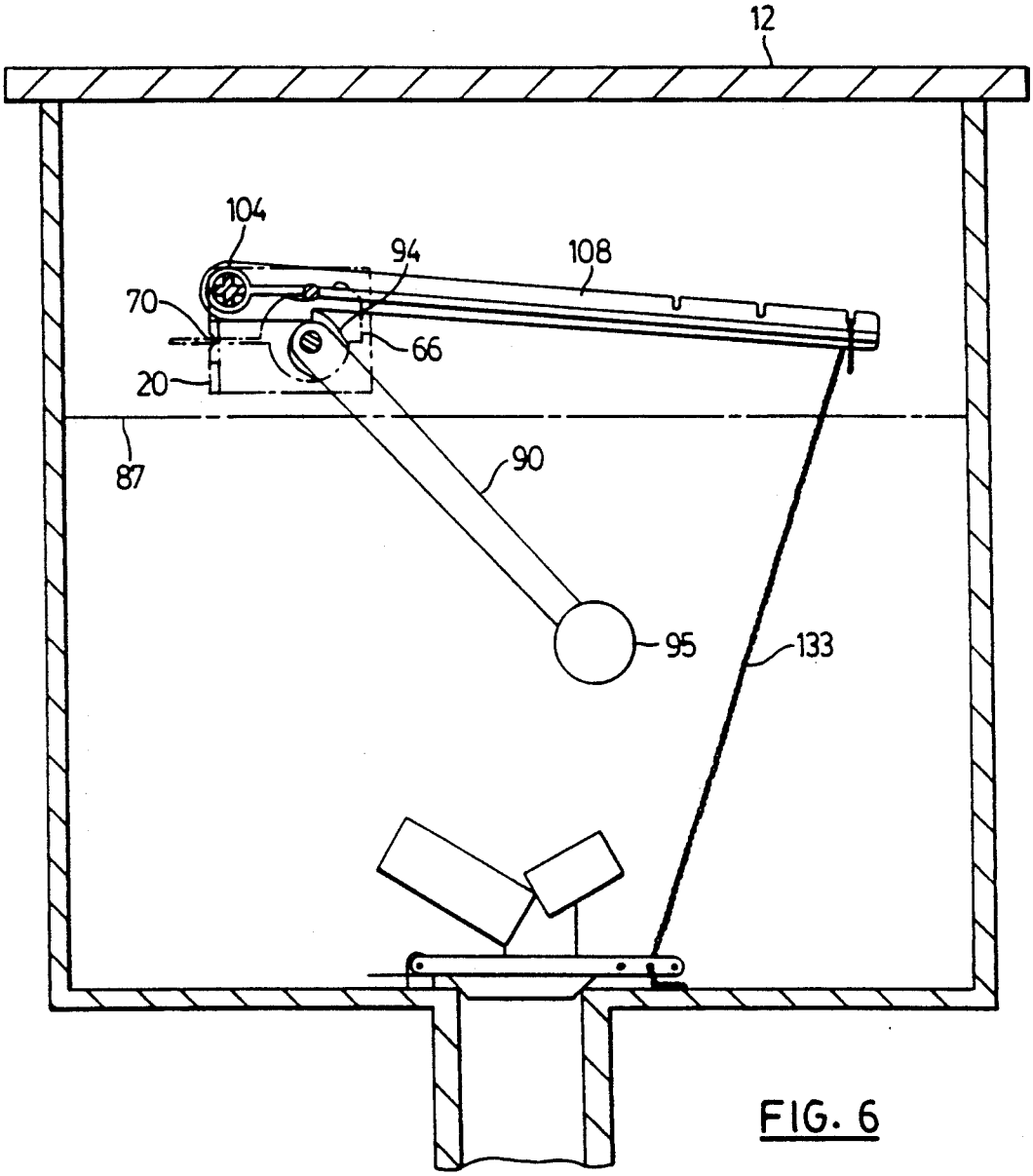
FIG. 6 shows the dual flush mechanism of FIG. 1 in a typical toilet tank.
Figure 10:
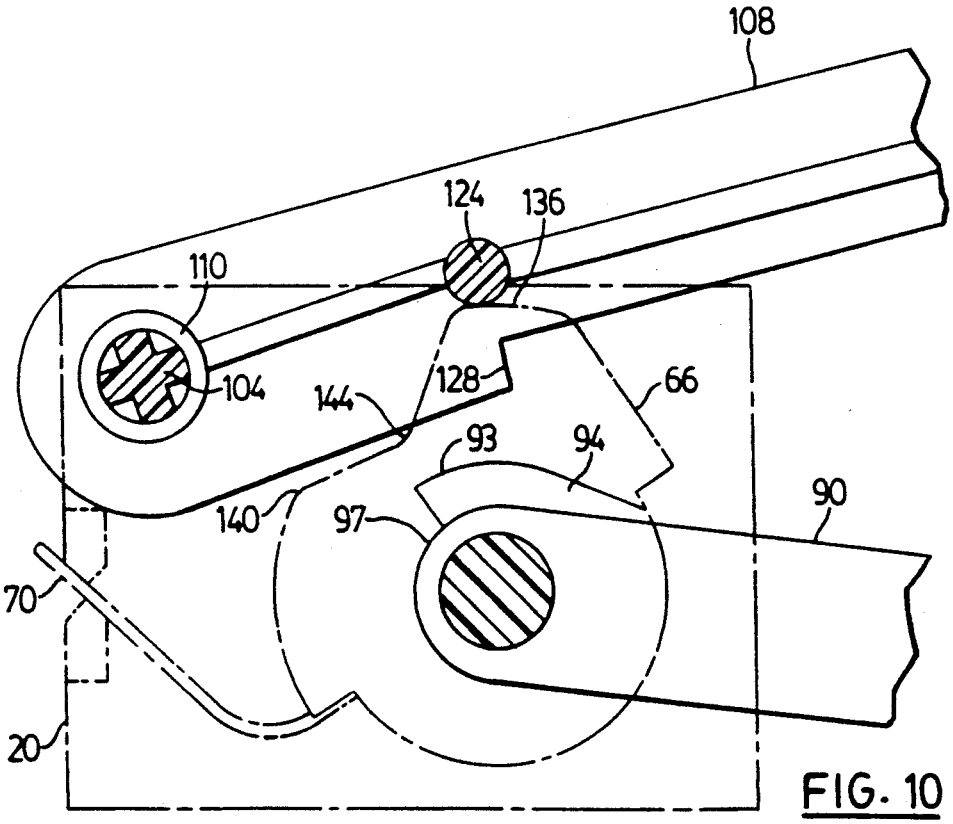
FIG. 10 shows another partial section of the mechanism showing the position of various components at the start of a long flush cycle is being started.

As best shown in FIG. 10, control arm 108 includes at its end adjacent bushing 110, cam followers 124 and 128. As best shown in FIG. 6, at the end opposite bushing 110, control arm 108 has a series of notches 132 which are sized to receive the link 133 from a standard main valve. Depending upon the dimensions of tank 12 and the type of main valve installed, one of notches 132 at the end of arm 108 is selected to receive the link in an appropriate position.

Figure 7:
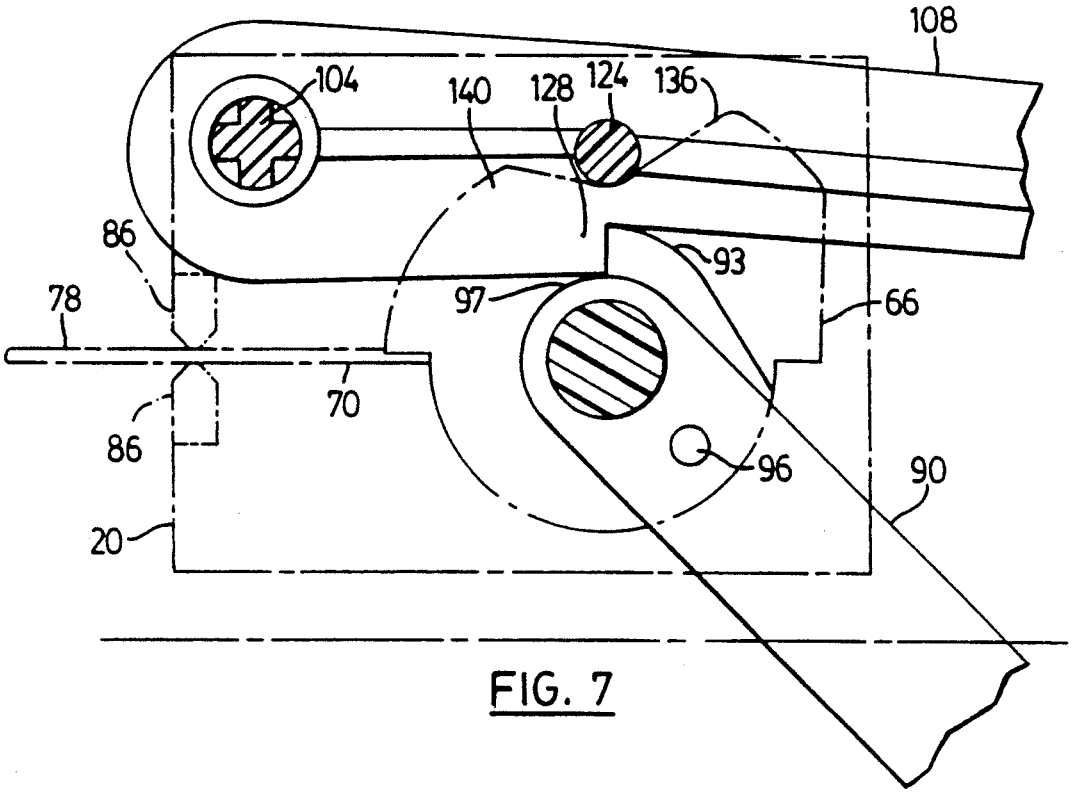
FIG. 7 shows a partial section of the mechanism at a datum position.
Figure 8:
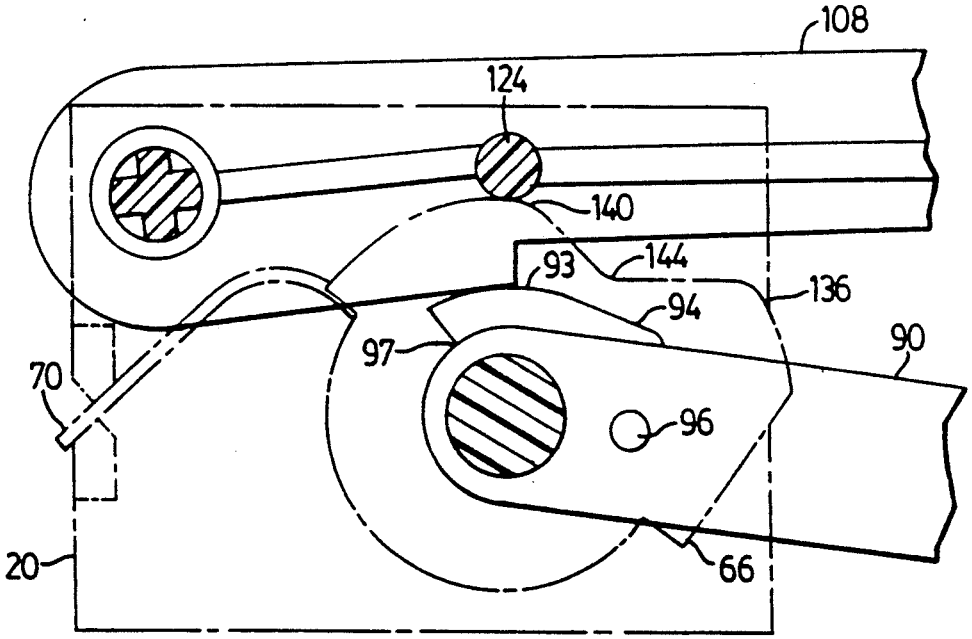
FIG. 8 shows another partial section of the mechanism showing the position of various components at the start of a short flush cycle.
Figure 9:
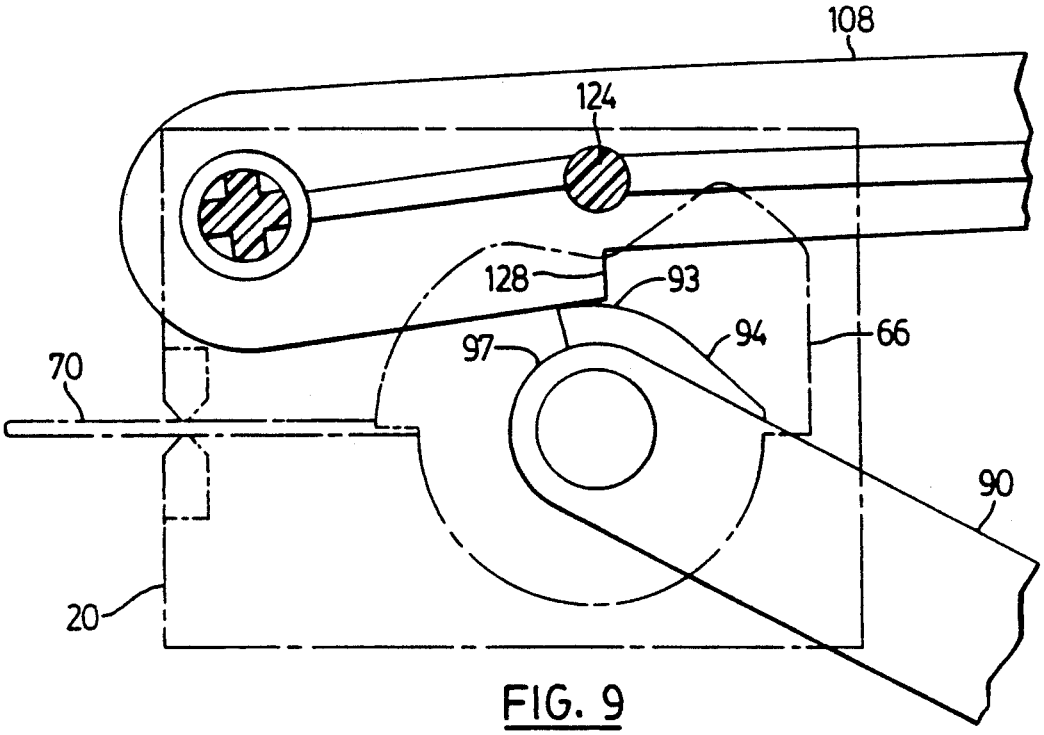
FIG. 9 shows another partial section of the mechanism showing the position of various components during a short flush cycle.

As shown in FIGS. 8 and 10, cam follower 124 rides on actuator cam 66 which has two lobes 136,140, each of which has an oppositely inclined cam surface which form a detent 144 at their intersection. As can be seen in the figures, lobe 136 has a greater throw than lobe 140. As mentioned above, spring 70 centers shaft 24 and thus cam follower 124 abuts detent 144 whenever handle 44 is released as shown in FIG. 7.

As shown in FIGS. 7 and 8, cam follower 128 rides on cam 94 which also has two different height lobes 93 and 97, which are separated by an inclined cam surface which is normal to the rotational axis of the cam 94.

In use, at the start of a cycle, the mechanism is in the position shown in FIG. 7 and the water level 87 in tank 12 is above float 95, as shown in FIG. 6. Due to the buoyancy which is thus produced by float 95, cam 94 and cam follower 128 are in the positions shown in FIG. 7, with cam 94 being urged against follower 128 by the buoyancy developed by float 95.

To start a short flush, the user turns handle 44 clockwise which moves the mechanism from the position shown in FIG. 7 to that shown in FIG. 8. Namely, actuating cam 66 rotates with handle 44 and follower 124 rides up lobe 140, lifting arm 108 and the main valve. The height of lobe 140 is such that the main valve is moved to a slightly opened position wherein it is subject to the venturi effect, or suction, developed by the water flowing from tank 12 to the toilet bowl through the valve seat.

As arm 108 is raised to this point, follower 128 is lifted off lobe 97 of control cam 94. This frees float 95 to rise the surface of the water level in tank 12, rotating arm 90 and control cam 94 about the rounded portion 64 of shaft 24. The user may then release the handle 44 which is returned to a centered position by spring 70. When the handle 44 is released, arm 108 drops until cam follower 128 abuts lobe 93 of control cam 94. Arm 108, is thus maintained in its lifted position and consequently the main valve is maintained in its partially opened position.

Arm 108 maintains the main valve in its partially open position until the water level in tank 12 drops to a cut-off level which is determined by float 95, arm 90 and the position of cam 94 on arm 90. At this cut-off level, float 95 will have dropped sufficiently so that arm 90 and cam 94 have rotated to a position wherein follower 128 drops off lobe 93, allowing arm 108 to return to its initial position. By adjusting the position of cam 94 on arm 90, the user can vary the cut-off level, and thus the volume of a short flush, as required.

When follower 128 drops off lobe 93, the suction on the main valve causes the main valve to close, ending the flush. As the main valve closes, arm 108 moves down and the mechanism is again in the position shown in FIG. 7. At this point, tank 12 refills in the normal manner and the rising water level again rises above float 95, to create a buoyant force urging cam 94 against follower 128 to complete the cycle.

To start a long flush, the user turns handle 44 counterclockwise which moves the mechanism from the position shown in FIG. 7 to that shown in FIG. 10. Namely, actuating cam 66 rotates with handle 44 and follower 124 rides up lobe 136, lifting arm 108 to a sufficient extent to open the main valve to its buoyant position. The user may then release the handle which is returned to a centered position by spring 70. Being in its buoyant position, the main valve remains open until tank 12 is substantially empty.

As in the case of the short flush, when arm 108 is lifted, lobe 93 rides under follower 128 as float 95 raises to the surface of the water level in tank 12. As the water level in tank 12 drops, cam 94 is rotated by the corresponding drop of float 95 and follower 128 drops onto lobe 97 allowing arm 108 to return to its initial condition. However, as the main valve is in its buoyant position, it remains open and the flush continues in the conventional manner until the main valve loses it buoyancy when tank 12 is substantially empty.

When the main valve closes at the end of the long flush, arm 90 is below the position shown in FIG. 7 and as tank 12 refills, float 95 raises until arm 90 and cam 94 are again in the positions shown in FIG. 7 and cam 94 is urged against cam follower 128.

The flush control mechanism according to the present invention provides significant advantages in that it may be easily retrofitted to existing toilets without requiring the replacement of any existing hardware except for the handle and arm. Furthermore, the design of flush control mechanism provides simplified construction allowing for economical fabrication and reliable operation.

We claim:

1. A dual flush control mechanism for a toilet having a main valve between the bowl and tank of the toilet, said valve being operable between a closed position, an intermediate position and an open position wherein said valve remains open until said tank is substantially emptied, comprising:

an operating handle movable to first and second extents;

a valve control arm operably connected to said valve;

a first cam follower operably connected to said valve control arm;

a control float arm movable with changes in the water level in said tank; and an actuating cam operably connected to said handle and including first and second cam surface having different throw heights with a detent formed at the intersection therebetween, wherein said first cam follower rides on said first cam surface to operate said valve control arm to move said valve to said open position when said handle is moved to said first extent and said first cam follower rides on said second cam surface to operate said valve control arm to move said valve to said intermediate position when said handle is moved to said second extent, said control float arm conditioning said valve control arm to release said valve from said intermediate position when the water level in said tank drops below a predetermined level.

2. A dual flush control mechanism according to claim 1 further comprising:

a control cam operably connected to said control float arm; and a second cam follower operably connected to said valve control arm, wherein said second cam follower and said control cam operate to inhibit said valve control arm from allowing said valve to leave said intermediate position until said water level drops below said predetermined level.

3. A dual flush mechanism according to claim 2 wherein said actuating cam is biased to move said detent into abutment with said first cam follower.

4. A dual flush mechanism according to claim 3 wherein the position of said control cam with respect to said control float arm may be varied to select said predefined level.

5. A dual flush mechanism according to claim 1 wherein said first extent is in an opposite direction to said second extent.

6. A dual flush mechanism according to claim 1 wherein said first and second cam surfaces are oppositely inclined.

7. A toilet comprising:

a water tank;

a bowl connected to said water tank to allow water to drain from said tank into said bowl;

a water entry control mechanism to control filling of said tank;

a main valve to inhibit water flow from said tank to said bowl, said valve operable between a closed position, an intermediate position and an open position wherein said valve remains open until said tank is substantially emptied;

an operating handle movable to first and second extents;

a valve control arm operably connected to said valve;

a first cam follower operably connected to said valve control arm;

a control float arm movable with changes in the water level in said tank; and an actuating cam operably connected to said handle and including first and second cam surfaces having different throw heights with a detent formed at the intersection therebetween, wherein said first cam follower rides on said first cam surface to operate said valve control arm to move said valve to said open position when said handle is moved to said first extent and said first cam follower rides on said second cam surface to operate said valve control arm to move said valve to said intermediate position when said handle is moved to said second extent, said control float arm conditioning said valve control arm to release said valve from said intermediate position when the water level in said tank drops below a predetermined level.

* * * * *